US006602931B2

(12) United States Patent
Chen et al.

(10) Patent No.: US 6,602,931 B2
(45) Date of Patent: Aug. 5, 2003

(54) POLYURETHANE-FORMING BINDERS

(75) Inventors: Chia-hung Chen, Dublin, OH (US); Jorg Kroker, Powell, OH (US)

(73) Assignee: Ashland Inc., Dublin, OH (US)

( * ) Notice: Subject to any disclaimer, the term of this patent is extended or adjusted under 35 U.S.C. 154(b) by 189 days.

(21) Appl. No.: 09/911,677

(22) Filed: Jul. 24, 2001

(65) Prior Publication Data

US 2003/0042000 A1 Mar. 6, 2003

(51) Int. Cl.[7] ..... B22C 1/22
(52) U.S. Cl. ..... 523/142
(58) Field of Search ..... 523/142, 139, 523/143, 149

(56) References Cited

U.S. PATENT DOCUMENTS 6,017,978 A 1/2000 Chen et al.

FOREIGN PATENT DOCUMENTS

WO 01/41954 A1 6/2001 ..... B22C/1/22

*Primary Examiner*—Edward J. Cain
*Assistant Examiner*—Katarzyna I Wyrozebski Lee
(74) *Attorney, Agent, or Firm*—David L. Hedden

(57) ABSTRACT

This invention relates to a polyurethane-forming no-bake foundry binder comprising a (a) polyol component comprising (1) a polyol selected from the group consisting of polyether polyols, aminopolyols, polyester polyols, and mixtures thereof, and (2) a hydrogenfluoride of aminosilanol, (b) a polyisocyanate component, and optionally (c) a liquid tertiary amine catalyst component. Foundry mixes are prepared by mixing the binder system with a foundry aggregate by a no-bake process. The resulting foundry shapes are used to cast metal parts from ferrous and non-ferrous metals.

17 Claims, No Drawings

POLYURETHANE-FORMING BINDERS

CROSS-REFERENCE TO RELATED APPLICATIONS

Not Applicable.

CLAIM TO PRIORITY

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

This invention relates to a polyurethane-forming no-bake foundry binder comprising a (a) polyol component comprising (1) a polyol selected from the group consisting of polyether polyols, aminopolyols, polyester polyols, and mixtures thereof, and (2) a hydrogenfluoride of aminosilanol, (b) a polyisocyanate component, and optionally (c) a liquid tertiary amine catalyst component. Foundry mixes are prepared by mixing the binder system with a foundry aggregate by a no-bake process. The resulting foundry shapes are used to cast metal parts from ferrous and non-ferrous metals.

(2) Description of the Related Art

One of the major processes used in the foundry industry for making metal parts is sand casting. In sand casting, disposable foundry shapes (usually characterized as molds and cores) are made by shaping and curing a foundry binder system that is a mixture of sand and an organic or inorganic binder. The binder is used to strengthen the molds and cores.

Two of the major processes used in sand casting for making molds and cores are the no-bake process and the cold-box process. In the no-bake process, a liquid curing agent is mixed with an aggregate and binder, and shaped to produce a cured mold and/or core. In the cold-box process, a gaseous curing agent is passed through a compacted shaped mix to produce a cured mold and/or core. Phenolic urethane binders, cured with a gaseous tertiary amine catalyst, are often used in the cold-box process to hold shaped foundry aggregate together as a mold or core. See for example U.S. Pat. No. 3,409,579. The phenolic urethane binder system usually consists of a phenolic resin component and polyisocyanate component which are mixed with sand prior to compacting and curing to form a foundry binder system. Because the foundry mix often sits unused for extended lengths of time, the binder used to prepare the foundry mix must not adversely affect the benchlife of the foundry mix.

Among other things, the binder must have a low viscosity, be gel-free, remain stable under use conditions, and cure efficiently. The cores and molds made with the binders must have adequate tensile strengths under normal and humid conditions, and release effectively from the pattern. Binders, which meet all of these requirements, are not easy to develop.

Because the cores and molds are often exposed to high temperatures and humid conditions, it also desirable that the foundry binders provide cores and molds that have a high degree of humidity resistance. This is particular important for foundry applications, where the core or mold is exposed to high humidity conditions, e.g. during hot and humid weather, or where the core or mold is subjected to an aqueous core-wash or mold coating application for improved casting quality.

Phenolic urethane cold-box and no-bake foundry binders often contain a silane coupling agent and/or aqueous hydrofluoric acid to improve humidity resistance. See for example U.S. Pat. No. 6,017,978. The silane and hydrofluoric acid are typically added to the phenolic resin component of the binder.

However, the addition of the silane and free aqueous hydrofluoric acid in phenolic urethane binders often results in one or more problems. For instance, the hydrofluoric acid usually requires special handling procedures, particularly because it is known to etch vitreous materials, e.g. flow control sight tubes commonly used in pipe line systems to convey the binder from storage to its point of use. Additionally, in the case of phenolic urethane no-bake binders, the use of the silane and hydrofluoric acid retards the chemical reaction, and thus increases the worktime of the foundry mix and the striptime of the core or mold. If a longer time is required for the sand mix to set, this negatively affects productivity.

All citations referred to under this description of the "Related Art" and in the "Detailed Description of the Invention" are expressly incorporated by reference.

BRIEF SUMMARY OF THE INVENTION

This invention relates to a polyurethane-forming no-bake binder comprising:

(a) a polyol component comprising,
  (1) a polyol selected from the group consisting of polyether polyols, aminopolyols, polyester polyols, and mixtures thereof,
  (2) a hydrogenfluoride of aminosilanol, (b) a polyisocyanate component, and optionally (c) a liquid amine curing catalyst.

The compositions contain little or no free fluorinated acid and will not etch glass. Cores made with the binders have excellent humidity resistance, and this is achieved without substantial adverse effects on the reactivity of the binder, i.e. the worktime of the foundry mix and the striptime of the core from the pattern is not substantially increased, particularly when compared to the worktime and striptime increases, which result when phenolic urethane no-bake binders are used in similar formulations. This is significant because, if a longer time is required for the sand mix to set, this adversely affects productivity.

In contrast to the approaches shown in the prior art, where either HF or an aminosilane is used alone or in combination, the hydrogenfluorides of aminosilanols are the reaction product of a fluorinated acid (preferably aqueous HF) and an aminoalkoxysilane The invention also relates to the use of the binders in foundry mixes, core-making by the no-bake process, and in the casting of ferrous and non-ferrous metals.

BRIEF DESCRIPTION OF THE SEVERAL VIEWS OF THE DRAWINGS

Not Applicable.

DETAILED DESCRIPTION OF THE INVENTION

The detailed description and examples will illustrate specific embodiments of the invention and will enable one skilled in the art to practice the invention, including the best mode. It is contemplated that many equivalent embodiments of the invention will be operable besides those specifically disclosed.

The hydrogenfluorides of aminosilanols used in the binder have the following structural formula:

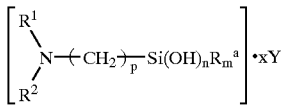

wherein:

(1) $R^1$ and $R^2$ are selected from the group consisting of H; alkyl groups, aryl groups, substituted alkyl groups, aryl groups, mixed alky-aryl groups; di- or triamino groups, amino alkyl groups, amino aryl groups, amino groups having mixed alky-aryl groups, and amino groups having substituted alkyl groups, aryl groups, mixed alky-aryl groups; aminocarbonyl groups; and alkylsilanol groups, preferably where at least one of the $R_1$ and $R_2$ groups is H and the other group is an unsubstituted alkyl group having 1–4 carbon atoms;

(2) n is a whole number from 1 to 3, preferably where $n \geqq 1$;

(3) n+m=3;

(4) p is a whole number from 1 to 5, preferably 2 to 3

(5) $R^a$ is selected from the group consisting of alkyl groups, aryl groups, mixed alky-aryl groups, substituted alkyl groups, aryl groups, mixed alkyl-aryl groups, preferably an unsubstituted alkyl group having from 1–4 carbon atoms;

(6) x is a number and is equal to 0.1 and 3 per nitrogen atom of the aminosilanol, and is preferably from 1 to 2.5 per nitrogen atom in the aminoalkoxysilane; and (7) Y=HF or HF complex, which results from a compound that hydrolyzes to yield HF, for instance ammonium fluoride, ammoniumbifluoride, potassium bifluoride, tetrafluoroboric acid, hexafluorophosphoric acid, hexafluorosilicic acid, N,N-diisopropyl aminetris (hydrogenfluoride), N,N'-dimethyl-2-imidazolidone-hexakis(hydrogenfluoride), preferably HF.

The hydrogenfluorides of aminosilanols are the reaction products formed by the reaction of an aqueous solution of a fluorinated acid, either hydrofluoric acid or a fluorinated acid, which hydrolyzes to yield hydrofluoric acid, with aminoalkoxysilanes. Preferably, the fluorinated acid is hydrofluoric acid, most preferably an aqueous solution of hydrofluoric acid, containing from 10 to 90 weight percent water, preferably 30–60 weight percent water. Other fluorinated acids that can be used are ammoniumfluoride, ammoniumbifluoride, potassiumbifluoride, tetrafluoroboric acid, hexafluorophosphoric acid, hexafluorosilicic acid, N,N-diisopropylaminetris(hydrogenfluoride), and N,N'-dimethyl-2-imidazolidone-hexakis(hydrogenfluoride).

The aminoalkoxysilanes used to prepare the hydrogenfluorides of the aminosilanols have the following structural formula:

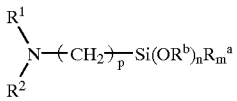

wherein:

(1) $R^1$ and $R^2$ are selected from the group consisting of H; alkyl groups, aryl groups, mixed alky-aryl groups, substituted alkyl groups, aryl groups; di- or triamino groups, amino alkyl groups, amino aryl groups, amino groups having mixed alky-aryl groups, and amino groups having substituted alkyl groups, aryl groups, mixed alky-aryl groups; aminocarbonyl; and alkoxysilane groups, where $R^1$ and $R^2$ can be the same or different and preferably where at least one of the $R_1$ and $R_2$ groups is H, and the other group is an unsubstituted alkyl group having 1–4 carbon atoms;

(2) n is a whole number from 1 to 3, preferably where $n \geqq 1$;

(3) n+m=3;

(4) p is a whole number from 1 to 5, preferably 2 to 3, and (5) $R^a$ and $R^b$ are selected from the group consisting of alkyl groups, aryl groups, mixed alky-aryl groups, substituted alkyl groups, aryl groups, preferably an unsubstituted alkyl group having from 1–4 carbon atoms, and can be identical or different.

Specific examples of aminoalkoxysilanes include 3-aminopropyldimethyl-methoxysilane, 3-aminopropyltrimethoxysilane, 3-aminopropyltriethoxysilane, 3-aminopropylmethyl-dimethoxysilane 3-aminopropylmethyl-diethoxysilane, N-(n-butyl)-3-aminopropyl-trimethoxysilane, N-aminoethyl-3-aminopropylmethyl-dimethoxysilane, 3-ureidopropyltrimethoxysilane, 3-ureidopropyltriethoxysilane, N-phenyl-3-aminopropyltrimethoxysilane, N-[(N'-2-aminoethyl)-2-aminoethyl)]-3-aminopropyltrimethoxysilane and bis (3-trimethoxysilylpropyl) amine. Preferably used as the aminoalkoxysilanes are aminoalkoxysilanes where $R^1$ and $R^2$ are selected from the group consisting of H; alkyl groups, aryl groups, substituted alkyl groups, aryl groups, mixed alky-aryl groups; di- or triamino groups, amino alkyl groups, amino aryl groups, amino groups having mixed alky-aryl groups, and amino groups having substituted alkyl groups, aryl groups, mixed alky-aryl groups; and alkylsilanol groups, preferably where at least one of the $R_1$ and $R_2$ groups is H and the other group is an unsubstituted alkyl group having 1–4 carbon atoms.

The fluorinated acid and/or the aminoalkoxysilane may contain a polar solvent. Examples of polar solvents include, for example, water, methanol, ethanol, isopropanol and butanol; ethylene and propylene carbonate; ethylene glycol, propylene glycol, and ethers thereof; isophorone; tetrahydrofuran, dioxolane, 4-methyl dioxolane and 1,3-dioxepane. Typically the amount of solvent is from 0 to 1000, preferably 10 to 300 weight percent based on the weight of the aminoalkoxysilane.

The hydrogenfluorides of aminosilanols are prepared by reacting a fluorinated acid with the aminoalkoxysilane, typically in a plastic reaction vessel, preferably at temperatures of 10° C. to 70° C. and preferably at atmospheric pressure. The fluorinated acid is gradually added to the aminoalkoxysilane and the mixture is stirred gently. A modest exotherm results, and eventually a thin and clear liquid is obtained. The reaction product is tested for free fluorinated acid by bringing into contact with glass to see whether it etches the glass. The stoichiometrical ratio of fluorine of the fluorinated acid to nitrogen of the aminoalkoxysilane is from 0.1:1.0 to 3.0:1.0, preferably from 1.0:1.0 to 2.5:1.0.

The hydrogenfluorides of aminosilanols are particular useful additives for non phenolic urethane foundry binders. These binders are well known in the art and commercially available. They typically comprise a polyether polyol component and a polyisocyanate component, which are cured in the presence of a tertiary amine catalyst. The amount of hydrogenfluoride of an aminosilanol added to the binder is from 0.1–10.0 weight percent, based on the weight of the polyol component, preferably from 0.15 to 2.0 weight percent.

The polyol component comprises a polyol selected from the group consisting of polyether polyols, aminopolyols, polyester polyols, and mixtures thereof. Polyether polyols typically used in the polyol component are liquid polyether polyols or blends of liquid polyether polyols typically having a hydroxyl number of from about 200 to about 1000, preferably about 300 to about 800 milligrams of KOH based upon one gram of polyether polyol. The viscosity of the polyether polyol is typically from 100 to 1000 centipoise, preferably from 200 to 700 centipoise, most preferably 250 to 600 centipoise. The polyether polyols may have primary and/or secondary hydroxyl groups.

These polyether polyols are commercially available and their method of preparation and determining their hydroxyl value is well known. The polyether polyols are prepared by reacting an alkylene oxide with a polyhydric alcohol in the presence of an appropriate catalyst such as sodium methoxide according to methods well known in the art. Any suitable alkylene oxide or mixtures of alkylene oxides may be reacted with the polyhydric alcohol to prepare the polyether polyols. The alkylene oxides used to prepare the polyether polyols typically have from two to six carbon atoms. Representative examples include ethylene oxide, propylene oxide, butylene oxide, amylone oxide, styrene oxide, or mixtures thereof. The polyhydric alcohols typically used to prepare the polyether polyols generally have a functionality greater than 2.0, preferably from 2.5 to 5.0, most preferably from 2.5 to 4.5. Examples include ethylene glycol, diethylene glycol, propylene glycol, trimethylol propane, and glycerine.

Aminopolyols typically used in the polyol component are described in U.S. Pat. No. 4,448,907, and are normally produced as the reaction product of an alkylene oxide and an amine compound. In general, any polyol containing at least one or more tertiary amine groups are considered to be within the scope of the definition of "amine polyol". The alkylene oxides which are used to prepare the amine polyols are preferably ethylene oxide and propylene oxide. However, it appears feasible to use other alkylene oxides as well. The amine compounds which react with alkylene oxides to yield the amine polyols useful in the binder composition constituting this invention include ammonia and mono and polyamino compounds with primary or secondary amino nitrogens. Specific examples include aliphatic amines such as primary alkyl amines, ethylene diamine, diethylene triamine and triethylene tetramine, cycloaliphatic amines, aromatic amines, such as ortho-, meta-, and para-phenylene diamines, aniline-formaldehyde resins and the like. The aminopolyols typically have a hydroxyl number of from about 200 to 1000, preferably from about 600 to 800.

Polyester polyols typically used in the polyol component are aliphatic and/or aromatic polyester polyols. Preferred polyester polyols are blends of liquid aromatic polyester polyols, which typically have a hydroxyl number from about 200 to 2,000, preferably from 200 to 1200, and most preferably from 250 to 800; a functionality equal to or greater than 2.0, preferably from 2 to 4; and a viscosity of 500 to 50,000 centipoise at 25° C., preferably 1,000 to 35,000, and most preferably 1,500 to 25,000 centipoise. They are typically prepared by ester interchange of aromatic ester and alcohols or glycols by an acidic catalyst. The amount of the aromatic polyester polyol in the polyol component is typically from 2 to 65 weight percent, preferably from 10 to 50 weight percent, most preferably from 10 to 40 weight percent based upon the polyol component. Examples of aromatic esters used to prepare the aromatic polyesters include phthalic anhydride and polyethylene terephthalate. Examples of alcohols used to prepare the aromatic polyesters are ethylene glycol, diethylene glycol, triethylene glycol, 1,3-propane diol, 1,4-butane diol, dipropylene glycol, tripropylene glycol, tetraethylene glycol, glycerin, and mixtures thereof Examples of commercially available aromatic polyester polyols are STEPANPOL polyols manufactured by Stepan Company, TERATE polyol manufactured by KOSA, THANOL aromatic polyol manufactured by Eastman Chemical, and TEROL polyols manufactured by Oxide Inc.

Although not necessarily preferred or required, the polyol component may contain solvents. Although not necessarily preferred, the polyol component may also contain phenolic resins, e.g. novolac and phenolic resole resins. If a phenolic resin is added to the polyether polyol, the preferred phenolic resins used are benzylic ether phenolic resins which are specifically described in U.S. Pat. No. 3,485,797 which is hereby incorporated by reference into this disclosure.

The polyisocyanate component of the binder typically comprises a polyisocyanate and organic solvent. The polyisocyanate has a functionality of two or more, preferably 2 to 5. It may be aliphatic, cycloaliphatic, aromatic, or a hybrid polyisocyanate. Mixtures of such polyisocyanates may be used. Also, it is contemplated that chemically modified polyisocyanates, prepolymers of polyisocyanates, and quasi prepolymers of polyisocyanates can be used. Optional ingredients such as release agents may also be used in the polyisocyanate hardener component.

Representative examples of polyisocyanates which can be used are aliphatic polyisocyanates such as hexamethylene diisocyanate, alicyclic polyisocyanates such as 4,4'-dicyclohexylmethane diisocyanate, and aromatic polyisocyanates such as 2,4'- and 2,6-toluene diisocyanate, diphenylmethane diisocyanate, and dimethyl derivates thereof. Other examples of suitable polyisocyanates are 1,5-naphthalene diisocyanate, triphenylmethane triisocyanate, xylylene diisocyanate, and the methyl derivates thereof, polymethylenepolyphenyl isocyanates, chlorophenylene-2,4-diisocyanate, and the like.

The polyisocyanates are used in sufficient concentrations to cause the curing of the phenolic resin when catalyzed with a tertiary amine curing catalyst. In general the isocyanato group ratio of the polyisocyanate component to the hydroxyl groups of the polyether polyol component is from 1.25:1 to 1:1.25, preferably about 1:1. The polyisocyanate is used in a liquid form. Solid or viscous polyisocyanates must be used in the form of organic solvent solutions. In general, the solvent concentration will be in the range of up to 80% by weight of the resin solution and preferably in the range of 20% to 80%.

Those skilled in the art will know how to select specific solvents for the polyisocyanate component. Non polar solvents, e.g. aromatic solvents, are useful because they are compatible with the polyisocyanate. Examples of aromatic solvents include xylene and ethylbenzene. The aromatic solvents are preferably a mixture of aromatic solvents that have a boiling point range of 125° C. to 250° C.

The solvent component can include drying oils such as disclosed in U.S. Pat. No. 4,268,425. Such drying oils include glycerides of fatty acids which contain two or more double bonds. Also, esters of ethylenically unsaturated fatty acids such as tall oil esters of polyhydric alcohols or monohydric alcohols can be employed as the drying oil. In addition, the binder may include liquid dialkyl esters such as dialkyl phthalate of the type disclosed in U.S. Pat. No. 3,905,934 such as dimethyl glutarate, dimethyl adipate, dimethyl succinate; and mixtures of such esters.

Although not required when the hydrogenfluoride of an aminosilanol is used, the binder may also contain a silane (typically added to the polyl component) having the following general formula:

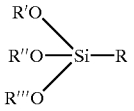

wherein R', R" and R'" are hydrocarbon radicals and preferably an alkyl radical of 1 to 6 carbon atoms and R is an alkyl radical, an alkoxy-substituted alkyl radical, and can be identical or different. The silane is preferably added to the phenolic resin component in amounts of 0.01 to 5 weight percent, preferably 0.1 to 1.0 weight percent based on the weight of the phenolic resin component.

When preparing an ordinary sand-type foundry shape, the aggregate employed has a particle size large enough to provide sufficient porosity in the foundry shape to permit escape of volatiles from the shape during the casting operation. The term "ordinary sand-type foundry shapes," as used herein, refers to foundry shapes which have sufficient porosity to permit escape of volatiles from it during the casting operation.

The preferred aggregate employed for ordinary foundry shapes is silica wherein at least about 70 weight percent and preferably at least about 85 weight percent of the sand is silica. Other suitable aggregate materials include zircon, olivine, aluminosilicate sand, chromite sand, and the like. Although the aggregate employed is preferably dry, it can contain minor amounts of moisture.

In molding compositions, the aggregate constitutes the major constituent and the binder constitutes a relatively minor amount. In ordinary sand type foundry applications, the amount of binder is generally no greater than about 10% by weight and frequently within the range of about 0.5% to about 7% by weight based upon the weight of the aggregate. Most often, the binder content ranges from about 0.6% to about 5% by weight based upon the weight of the aggregate in ordinary sand-type foundry shapes.

The binder compositions are preferably made available as a two-part system with the polyol component in one part (Part I) and the polyisocyanate component as the other part (Part II). Usually, the polyol is first mixed with sand and then the polyisocyanate component is added. Methods of distributing the binder on the aggregate particles are well-known to those skilled in the art. The foundry binder system is molded into the desired shape, such as a mold or core, and allowed to cure.

The binder compositions can also comprise three parts, if a catalyst is used. In this application, the catalyst is typically added to the sand with the Part I. Effective curing catalysts and their use are described in U.S. Pat. No. 3,676,392. Useful liquid amines have a $pK_b$ value generally in the range of about 5 to about 11. Specific examples of such amines include 4-alkyl pyridines, isoquinoline, arylpyridines, 1-vinylimidazole, 1-methylimidazole, 1-methylbenzimidazole, and 1,4-thiazine. Preferably used as the liquid tertiary amine catalyst is an aliphatic tertiary amine, particularly (3-dimethylamino)propylamine. In general, the concentration of the liquid amine catalyst will range from about 0.2 to about 10.0 percent by weight of the phenolic resin, preferably 1.0 percent by weight to 5.0 percent by weight, most preferably 2.0 percent by weight to 6.0 percent by weight based upon the weight of the polyol.

The following abbreviations and components are used in the Examples:

ABBREVIATIONS

The following abbreviations are used:

| | |
|---|---|
| A-1160 | an ureidoalkoxysilane as a solution in 50% methanol, manufactured by OSi Specialties, a business of Crompton Corporation. |
| A-2120 | aminoethyl aminopropyl methyl dimethoxysilane, an aminoalkoxysilane, manufactured by Osi Specialties, a business of Crompton Corporation. |
| BOS | based on sand. |
| DBE | dibasic ester solvent. |
| HF | hydrofluoric acid, 49% by weight in water. |
| PEP SET ® 5110 | a polyol component (Part I), manufactured by Ashland Chemical Specialty Company, a subsidiary of Ashland, Inc., used in no-bake binders, comprising approximately equal amounts of PLURACOL QUADROL ® polyol, (manufactured by BASF Corporation) and an aromatic solvent. |
| PEP SET ® 5230 | a polymeric isocyanate component (Part II) used in no-bake binders, manufactured by Ashland Chemical, subsidiary of Ashland, Inc., comprising a polymeric isocyanate component comprising polymeric diphenylmethylene diisocyanate having a functionality of about 2.5 to 2.7 and an aromatic solvent in an approximate ratio of 2:1. |
| % RH | relative humidity %. |
| ST | striptime, used in connection with the no-bake process for core/mold-making, is defined as the time elapsed between mixing the binder components and the sand and placing the sand mix in a pattern, and when the foundry shape reaches a level of 90 on the Green Hardness "B" Scale Gauge sold by Harry W. Dietert Co., Detroit, Michigan. |
| WT | worktime, used in connection with the no-bake process for core-making, is defined as the time elapsed between mixing the binder components and when the foundry shape reaches a level of 60 on the Green Hardness "B" Scale Gauge sold by Harry W. Dietert Co., Detroit, Michigan. |

EXAMPLES

While the invention has been described with reference to preferred embodiments, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is not intended that the invention be limited to the particular embodiments disclosed herein, but that the invention will include all embodiments falling within the scope of the appended claims. All amounts and percentages are by weight, unless otherwise expressly indicated.

Preparation of Hydrogen Fluorides of Aminosilanols Used in Examples

The hydrogenfluorides of aminosilanols are formed by the reaction of HF (49% concentration in water) and the aminoalkoxysilanes specified in Table I, which are 50% solutions in methanol. To make the hydrogenfluoride of the aminosilanol, the solution of aminoalkoxysilane in methanol was added to a plastic container, and then the HF (49% concentration in water) was added gradually and gently at room temperature, and mixed well.

A modest exothermic was observed, and the mixture was allowed to cool. The mixture was stored overnight to allow complete reaction, and a water-thin clear liquid was obtained. The components used to make the hydrogenfluorides of aminosilanols are set forth in Table I.

TABLE I (Preparation of hydrogenfluorides of aminosilanols)

| Adduct | HF (pbw) | Silane (pbw) | Solvent (pbw) |
|---|---|---|---|
| A | 12 | A-2120/(25) | MeOH/(25) |
| B | 12 | A-2120/(25) | Water/(25) |
| C | 12 | A-2120/(25) | MeOH/DBE(25/50) |
| D | 10 | A-1160/(25) | MeOH/(50) |

EXAMPLE 1

Comparison Test of Binders Used for Core-Making by No-Bake Process

In these examples, a two-component polyurethane-forming no-bake foundry binder, PEP SET® 5110/5230 binder, is used. Example A is a control and does not contain HF or silane. Example B is a comparison example which contains A-2120 at 0.5% by weight in the resin component. Example C is a comparison example which contains 0.2% by weight of HF in the resin component. Example 1 contains 1.0% of adduct A in the resin component.

Several test cores were prepared with the binders. The Part I and catalyst were mixed with Wedron 540 silica sand, and then the Part II was added. The weight ratio of Part I to Part II was 50/50 and the binder level was 1.2% by weight BOS. The resulting foundry mix is forced into a dogbone-shaped corebox and the tensile strengths of the test specimen ("dog bones") were measured using the standard procedure, ASTM # 329-87-S, known as the "Briquette Method".

The tensile strengths of the test cores made according to the examples were measured on a Thwing Albert Intellect II instrument. Tensile strengths were measured on freshly mixed sand. Tensile strengths of test cores made with the sand mixes were measured 30 minutes, 1 hour, and 3, hours, and 24 hours after removing them from the corebox. In order to check the resistance of the test cores to degradation by humidity, some of the test cores were stored in a humidity chamber for 24 hours at a humidity of 90 percent relative humidity before measuring the tensile strengths. Measuring the tensile strength of the test core enables one to predict how the mixture of sand and polyurethane-forming binder will work in actual foundry operations. Lower tensile strengths for the test cores indicate inferior binder performance.

The WT was also measured for the sand mixes used to prepare the cores, and the ST was measured when the cores were removed from the pattern.

TABLE II

| Example | A (Control) | B (w/A-1160) | C (w/HF) | 1 (w/adduct A) |
|---|---|---|---|---|
| Work time (min.) | 7.0 | 8.25 | 15.4 | 5.75 |
| Strip time (min.) | 8.75 | 10.30 | 23.8 | 8.75 |
| Tensile Development (psi) | | | | |
| 30 min | 140 | 135 | 35 | 148 |
| 1 hr | 155 | 151 | 58 | 197 |
| 3 hrs | 270 | 239 | 129 | 264 |
| 24 hrs | 303 | 289 | 276 | 284 |
| 24 hrs + 90% RH | **24** | **94** | **15** | **180** |

The sand tensile testing results shown in Table II clearly demonstrate that the cores made with Adduct A had the best humidity resistance (see bold faced numbers) than the cores made with the the binders of Comparative Examples A, B, or C. Good humidity resistance can minimize the breakage of the foundry core/mold during hot humidity summer time, and is important when a core coating is required for retention of mechanical strength and dimensional stability during the foundry applications.

The data related to WT/ST also indicate that this improvement in humidity resistance was achieved without a significant increase in WT/ST. This is important in terms of maintaining high productivity during the core making process. It is also significant because phenolic urethane binders tend to increase WT/ST in similar formulations.

EXAMPLES 2–4

Effect of Solvent Used with the Adduct

Example 1 was repeated, except 0.8 weight percent (based on the polyol component) of Adducts A, B and C (all made with A-2120 aminoalkoxysilane, but dissolved in different solvents) were added to the polyol comoponent, PEP SETS® 5110. The control did not contain an adduct, HF, or a silane. The results are summarized in Table III.

TABLE III

| Example<br>Adduct | Control<br>none | 2<br>A | 3<br>B | 4<br>C |
|---|---|---|---|---|
| Work time (min.) | 6.55 | 6.25 | 6.50 | 7.0 |
| Strip time (min.) | 8.00 | 11.75 | 8.75 | 10.5 |
| Tensile Development (psi) | | | | |
| 30 min | 169 | 192 | 178 | 171 |
| 1 hr | 225 | 262 | 211 | 228 |
| 3 hrs | 297 | 313 | 300 | 306 |
| 24 hrs | 268 | 326 | 316 | 285 |
| 24 hrs + 90% RH | **57** | **232** | **191** | **286** |

The data in Table III indicate that the binders containing Adducts A, B and C (made from A-2120 aminoalkoxysilane), which contained a variety of solvents, showed significantly improved humidity resistance (see the bold faced numbers), when compared to the Control.

We claim:

1. A no-bake foundry binder system comprising:

(a) polyol component comprising, (1) a polyol selected from the group consisting of polyether polyols, aminopolyols, polyester polyols, and mixtures thereof, and (2) a hydrogenfluoride of aminosilanol, and (b) a polyisocyanate component, wherein the amount of hydrogenfluoride of an aminosilanol is from 0.1 to 10 weight percent, based upon the weight percent of component (a).

2. The foundry binder of claim 1 wherein the hydrogenfluoride of an aminosilanol has the following structural formula:

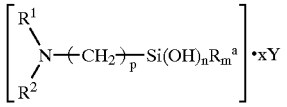

wherein:

(a) $R^1$ and $R^2$ are selected from the group consisting of H; alkyl groups, aryl groups, mixed alky-aryl groups, aryl groups; di- or triamino groups, amino alkyl groups, amino aryl groups, amino groups having mixed alky-aryl groups, aryl groups, mixed alky-aryl groups; aminocarbonyl groups; and alkylsilanol groups;

(b) n is a whole number from 1 to 3.

(c) n+m=3;

(d) $R^a$ is selected from the group consisting of alkyl groups, aryl groups, mixed alkyl-aryl groups, and mixed alkyl-aryl groups.

(e) x is a number which equals from 0.1 to 3.0 per nitrogen atom in the aminosilanol; and (f) Y=HF or HF complex.

3. The foundry binder of claim 2 wherein at least one of the $R^1$ and $R^2$ groups for the the structural formula for the hydrogenfluoride of an aminosilanol is H and the other group is an unsubstituted alkyl group having 1–3 carbon atoms.

4. The foundry binder of claim 3 wherein "n" for the hydrogenfluoride structural formula is ≧1.

5. The foundry binder of claim 4 wherein $R^a$ of the structural formula for the hydrogenfluoride of an aminosilanol is selected from the group consisting of unsubstituted alkyl group having from 1–4 carbon atoms.

6. The foundry binder of claim 5 wherein "Y" for the structural formula for the hydrogenfluoride of an aminosilanol is HF.

7. The foundry binder of claim 6 wherein "x" for the structural formula for the hydrogenfluoride of an aminosilanol is 1.

8. The foundry binder of claim 7 wherein the polyol is a polyether polyol having a hydroxyl number from 200 to 1000.

9. The foundry binder system of claim 8 wherein the NCO content of the polyisocyanate component is from 12% to 33%.

10. The foundry binder system of claim 9 wherein the ratio of hydroxyl groups of the polyol component to the polyisocyanate groups of the polyisocyanate component is from 1.0.1.25 to 1.25:1.0.

11. The foundry binder system of claim 10 which also contains a liquid tertiary amine curing catalyst.

12. The foundry binder system of claim 11 wherein the polyol component also contains an aromatic polyester polyol.

13. The foundry binder system of claim 12 wherein the tertiary amine curing catalyst is (3-dimethylamino) propylamine.

14. A foundry mix comprising:

A. a major amount of an aggregate; and

B. an effective bonding amount of the binder system of claim 1, 2, 3, 4, 5, 6, 7, 8, 9, 10, 11, 12, or 13.

15. A no-bake process for preparing a foundry shape which comprises:

(a) forming a foundry mix as set forth in claim 14;

(b) forming a foundry shape by introducing the foundry mix obtained from step (a) into a pattern; and (d) removing the foundry shape of step (c) from the pattern.

16. The process of claim 15 wherein the amount of said binder composition is about 0.5 percent to about 7.0 percent based upon the weight of the aggregate.

17. The process of casting a metal which comprises:

(a) preparing a foundry shape in accordance with claim 16;

(b) pouring said metal while in the liquid state into and a round said shape;

(c) allowing said metal to cool and solidify; and (d) then separating the molded article.

* * * * *